US008245447B2

(12) United States Patent
Oh

(10) Patent No.: US 8,245,447 B2
(45) Date of Patent: Aug. 21, 2012

(54) SLIDE DOOR ASSEMBLY WITH SAFETY DEVICE

(75) Inventor: Jong Hwan Oh, Seoul (KR)

(73) Assignee: Hyundai Motor Company, Seoul (KR)

( * ) Notice: Subject to any disclaimer, the term of this patent is extended or adjusted under 35 U.S.C. 154(b) by 486 days.

(21) Appl. No.: 12/507,483

(22) Filed: Jul. 22, 2009

(65) Prior Publication Data

US 2010/0018125 A1 Jan. 28, 2010

(30) Foreign Application Priority Data

Jul. 25, 2008 (KR) ..... 10-2008-0072772

(51) Int. Cl.
*E05F 11/00* (2006.01)

(52) U.S. Cl. ..... 49/360; 49/163; 49/164; 49/168; 295/155

(58) Field of Classification Search ..... 49/360, 49/163, 164, 166, 168, 169; 196/155; 292/216, 292/DIG. 46, DIG. 23
See application file for complete search history.

(56) References Cited

U.S. PATENT DOCUMENTS

| | | | | |
|---|---|---|---|---|
| 6,477,806 | B1 * | 11/2002 | Asada et al. | 49/169 |
| 6,513,285 | B2 * | 2/2003 | Isomura | 49/351 |
| 6,659,539 | B2 * | 12/2003 | Yogo et al. | 296/155 |
| 6,922,944 | B1 * | 8/2005 | Krueger | 49/171 |
| 6,966,148 | B2 * | 11/2005 | Choi | 49/360 |
| 7,100,325 | B2 * | 9/2006 | Ichinose | 49/168 |
| 7,178,854 | B2 * | 2/2007 | Ichinose et al. | 296/146.2 |
| 7,210,731 | B2 * | 5/2007 | Ichinose et al. | 296/155 |
| 7,288,907 | B2 * | 10/2007 | Kamiya et al. | 318/266 |
| 7,472,944 | B2 * | 1/2009 | Miyagawa et al. | 296/155 |
| 7,814,704 | B2 * | 10/2010 | Suzuki et al. | 49/26 |
| 8,069,611 | B2 * | 12/2011 | Kitayama | 49/348 |
| 2003/0116995 | A1 * | 6/2003 | Yogo et al. | 296/155 |
| 2004/0070231 | A1 * | 4/2004 | Yogo et al. | 296/155 |
| 2004/0194385 | A1 * | 10/2004 | Ichinose | 49/26 |
| 2004/0256883 | A1 * | 12/2004 | Ichinose et al. | 296/155 |
| 2006/0202507 | A1 * | 9/2006 | Miyagawa et al. | 296/155 |
| 2007/0107313 | A1 * | 5/2007 | Suzuki et al. | 49/360 |
| 2007/0138832 | A1 * | 6/2007 | Kraus et al. | 296/155 |

FOREIGN PATENT DOCUMENTS

| | | | |
|---|---|---|---|
| JP | 10-058980 | A | 3/1998 |
| JP | 11-115495 | A | 4/1999 |
| JP | 2000-160907 | A | 6/2000 |
| JP | 2001-173299 | A | 6/2001 |
| JP | 2001-288960 | A | 10/2001 |
| JP | 2004-099014 | A | 4/2004 |

(Continued)

*Primary Examiner* — Jerry Redman
(74) *Attorney, Agent, or Firm* — Morgan, Lewis & Bockius LLP

(57) ABSTRACT

The slide door assembly includes a lower rail provided on a chassis; a lower roller bracket mounted on a slide door and slidably engaged with the lower rail, the lower roller bracket having a roller; an interlock stopper mounted on one side of the lower roller bracket and pivoting to protrude toward the lower rail when a window pane is opened; a locking device mounted on the other side of the lower roller bracket; and a safety device for holding the slide door in an open state, the safety device being locked to the locking device by the interlock stopper when the slide door with the opened window pane is opened. In the case where the slide door is opened, with the window pane being opened to a certain height, the slide door is locked substantially at a three-quarter point by the safety device.

8 Claims, 7 Drawing Sheets

FOREIGN PATENT DOCUMENTS

| | | | |
|---|---|---|---|
| JP | 2007-077694 | A | 3/2007 |
| JP | 2007-177456 | A | 7/2007 |
| KR | 10-2005-0038158 | A | 4/2005 |
| KR | 10-2005-0055923 | A | 6/2005 |
| KR | 10-0793865 | B1 | 1/2008 |

* cited by examiner

<Prior Art>

<Prior Art>

<Prior Art>

SLIDE DOOR ASSEMBLY WITH SAFETY DEVICE

CROSS-REFERENCE TO RELATED APPLICATION

The present application claims priority to Korean Patent Application No. 10-2008-0072772 filed on Jul. 25, 2008, the entire contents of which is incorporated herein for all purposes by this reference.

BACKGROUND OF THE INVENTION

1. Field of the Invention

The present invention relates to a slide door assembly for a vehicle, and more particularly, to a slide door assembly with a safety device, which can improve the safety thereof by holding a slide door substantially three-quarters open when the slide door is opened with an open window pane.

2. Description of Related Art

In general, a slide door for a vehicle is configured to be guided in a fore-and-aft direction by three rails provided in parallel with one another.

Such a slide door includes a lower rail provided on a chassis of a vehicle and a lower roller bracket having a roller, attached to a slide door and slidably engaged with the lower rail.

The slide door can be slidably opened and closed by the roller attached to the lower roller bracket, which moves along the lower rail.

In the case of the slide door having a window pane that is moved up and down by a window regulator, a portion of a human body, such as a passenger's head or arm, could be exposed outwardly from the vehicle, while the window pane is opened. In this instance, when the slide door is opened, the exposed human body outwardly may collide against the chassis or be pressed by the slide door.

A controlling device for solving the above problem is disclosed in Korean Patent Unexamined Publication No. 10-2005-0047367 entitled "Window pane safety device for slide door."

The window pane safety device according to the prior art includes, as shown in FIGS. 1 to 3, a slide door 1 being slidable in a lateral direction along a lower rail of a chassis, a window pane 2 mounted on an upper end of the slide door 1 and being movable in downward or upward direction to open or close the window pane, and a window regulator 3 mounted on a center portion of the slide door 1 for moving the window pane 2 in downward or upward direction.

The window regulator 3 is connected to a cable 60 to actuate an operation lever 40 when the window pane 2 is moved up or down.

When the slide door 1 with the opened window pane is opened, the operation lever 40 actuates the safety device so that the slide door 1 is not fully opened.

The safety device includes, as shown in FIG. 3, a window safety striker 10 coupled to a lower roller plate 4 of the slide door 1 for guiding slide movement of the slide door 1; an interlock member 20 mounted on the lower roller plate 4 of the slide door 1 and locked in the window safety striker 10 in the state in which a window pane 2 is opened; a spring member 30 for resiliently supporting the interlock member 20; an operation lever 40 protruding from a side of the interlock member 20 and pivoting the interlock member; an interlock stopper for supporting the side of the interlock member 20 and controlling a position of the interlock member 20; a cable 60 connected to the operation lever 40 and pulling the operation lever 40 and pivoting the interlock member 20 when the window pane 2 is moved up, to prevent locking of the window safety striker 10; and controlling device 70 for detecting a position of a window pane connected to an end of the cable 60 and mounted on the window regulator 3. The controlling device 70 pulls the cable 60 to pivot the interlock member 20 when the position of the window pane 2 is over a certain height, and releases the cable 60 to return the interlock member 20 to its original position when the position of the window pane 2 is moved by a certain height or less.

In the state where the window pane 2 of the slide door 1 is opened, the slide door 1 can not be opened, since the interlock member 20 is locked by the window safety striker 10. Consequently, even though a human body is exposed to an open area of the window pane 2, it can prevent damage to the human body.

However, since the slide door 1 is not stationary in a closed direction, the slide door can move to be closed again due to its own weight when the vehicle is parked on a downhill slope. In this instance, if a portion of the human body exists in an open area of the window pane 2, the human body collides against a frame of the slide door, so that the human body is injured. Also, there is another problem in that an accident may happen when a passenger gets on or off a vehicle.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY OF THE INVENTION

Accordingly, various aspects of the present invention are directed to solving the above-mentioned problems of the prior art while maintaining certain advantages of the prior art.

Various aspect of the present invention are directed to a slide door assembly and a safety device for a vehicle. The slide door assembly and safety device may include a lower rail provided on a chassis of the vehicle in a longitudinal direction of the vehicle, a lower roller bracket mounted on a slide door and slidably engaged with the lower rail, an interlock stopper mounted on one side of the lower roller bracket and protruding toward the lower rail when a window pane is opened, a locking device mounted the other side of the lower roller bracket, and/or a safety device for holding the slide door in an open state. The safety device may be locked to the locking device by the interlock stopper when the slide door is opened with the opened window pane.

The lower roller bracket may include a roller. The safety device may be displaced approximately at a three-quarter point of the lower rail. The safety device may include a case attached to one side of the lower rail, a safety stopper movably coupled to the case and abutting against the interlock stopper, the safety stopper actuated by the interlock stopper, a striker actuated by the safety stopper and thereby pivotally locked to the locking device of the lower roller bracket, and/or a resilient member for resiliently supporting the safety stopper. The resilient member may be a coil spring.

The safety stopper may include a horizontal portion formed on one side of the case and movable in a longitudinal direction of the lower rail, a vertical portion extending downwardly from one side of the horizontal portion and abutting against the interlock stopper, and/or a hinge shaft provided on the other side of the horizontal portion. The striker may include a hinge portion pivotally coupled to a portion of the case via a hinge shaft formed on the case, an engaging piece provided on one side of the hinge portion and rotatably engaged with the hinge shaft of the safety stopper via a slot, and/or a locking piece provided on the other side of the hinge portion and selectively locked to the locking device. The hinge portion may include a cam and the case comprises a locking portion, and the cam may rotate around the locking portion as a center of rotation of the striker. The hinge portion, engaging piece and locking piece may be monolithically formed. The hinge portion may include a cam and the case may include a locking portion. The cam may rotate around the locking portion as a center of rotation of the striker.

Another aspect of the present invention is directed to a slide door system for holding a slide door when the slide door is opened with an open window pane. The system may include any of the above-mentioned the slide door assemblies. A passenger vehicle may include any of the above-mentioned the slide door assemblies.

In accordance with various aspects of the present invention, when the slide door is opened while the window pane is opened to a certain height, the slide door is locked substantially at a three-quarter point by the safety device. Consequently, even though a portion a passenger's body may extend in an open area of the window pane, it is possible to prevent the passenger from being injured. Also, it is possible to prevent the slide door from being again closed even though a vehicle is parked on a downhill slope.

The methods and apparatuses of the present invention have other features and advantages which will be apparent from or are set forth in more detail in the accompanying drawings, which are incorporated herein, and the following Detailed Description of the Invention, which together serve to explain certain principles of the present invention.

DETAILED DESCRIPTION OF THE INVENTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

A slide door assembly with a safety device according to an exemplary embodiment of the present invention will now be described in detail with reference to FIGS. 4 to 7.

Figure 1:
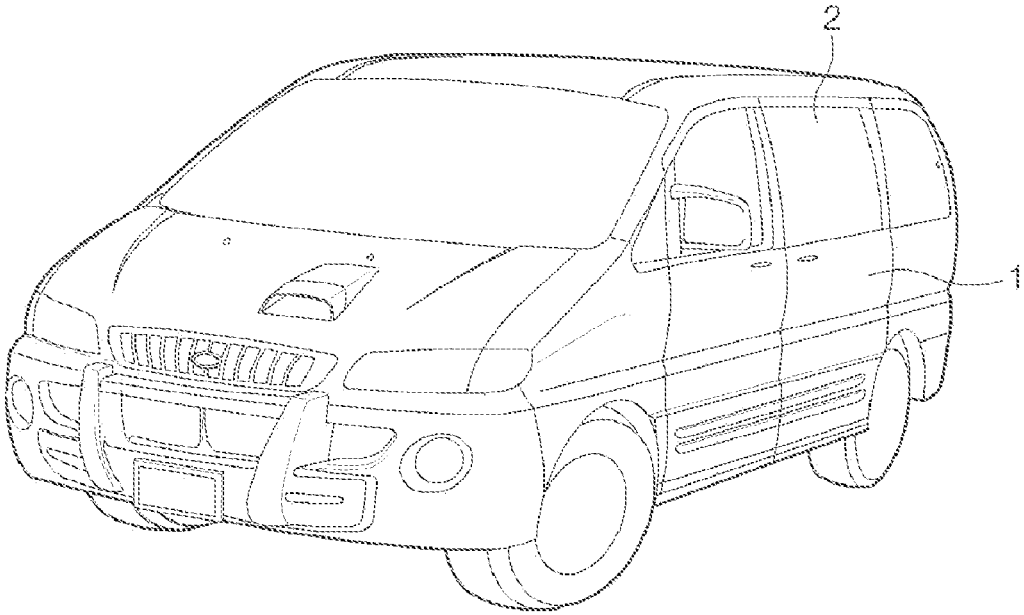
FIG. 1 is a perspective view illustrating a vehicle with a conventional slide door.
Figure 2:
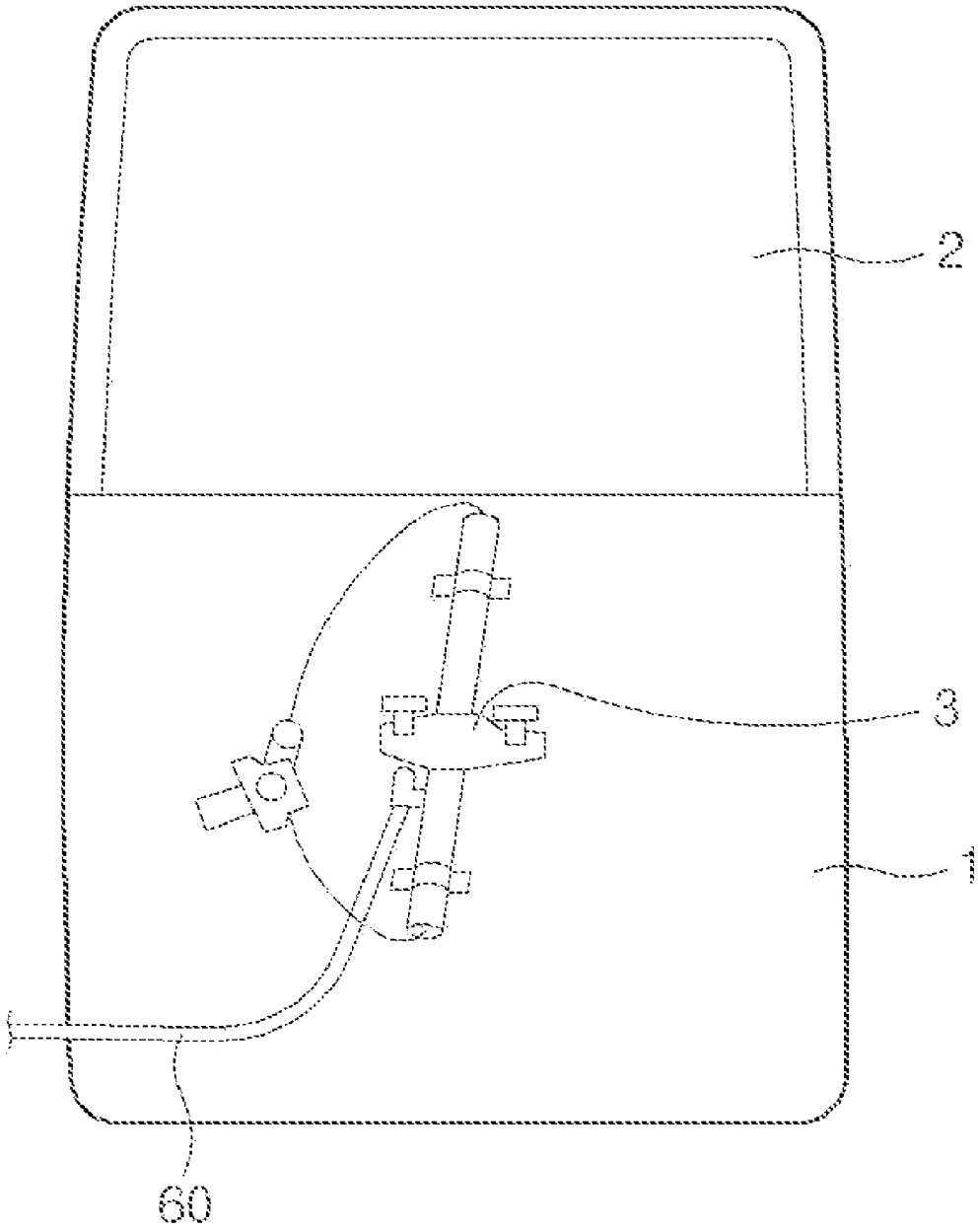
FIG. 2 is a front view illustrating a conventional slide door.
Figure 3:
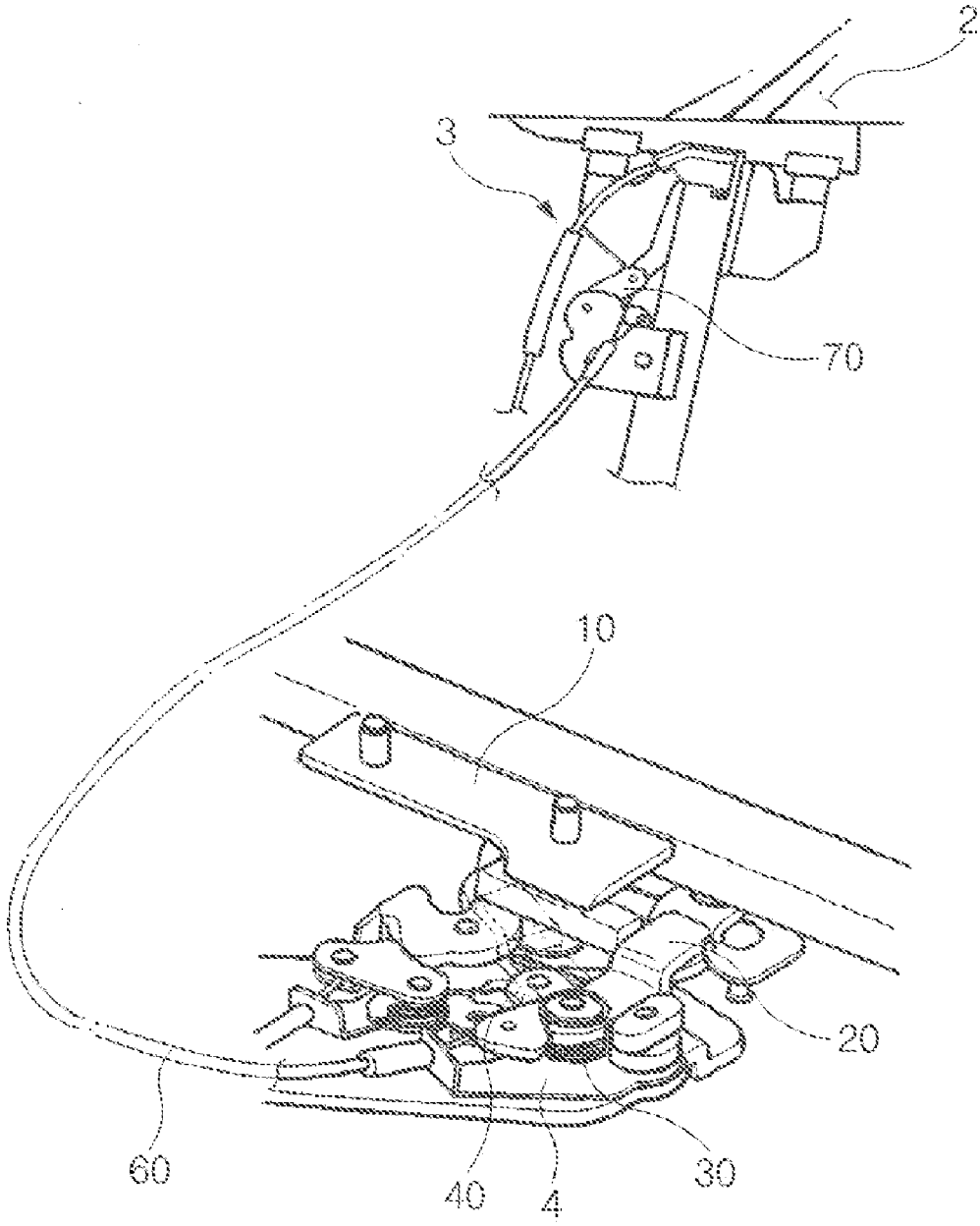
FIG. 3 is a perspective view illustrating a slide door assembly with a known safety device.
Figure 4:
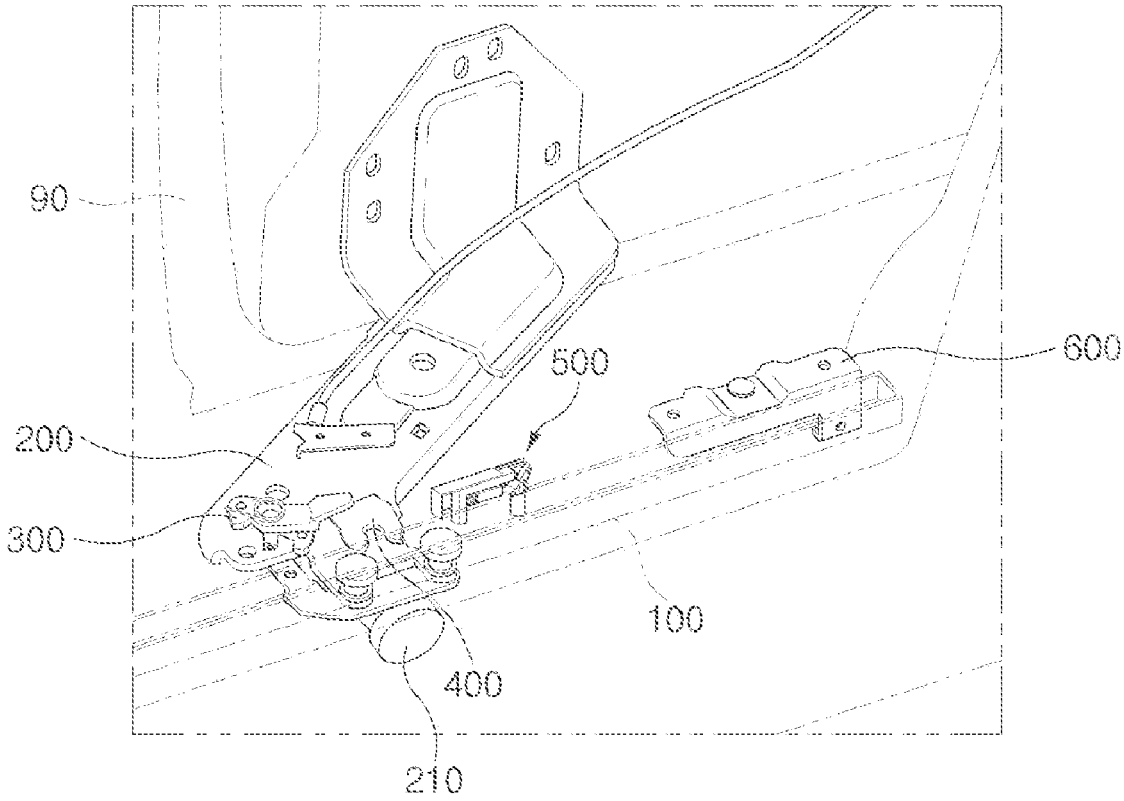
FIG. 4 is a perspective view illustrating an exemplary slide door assembly with a safety device according to an aspect of the present invention.

The slide door assembly according to the present invention includes, as shown in FIG. 4, a lower rail 100 provided on a chassis of a vehicle; a lower roller bracket 200 having a roller 210, mounted on a lower end of a rear side of a slide door 90 at one end thereof and slidably engaged with the lower rail 100 at the other end thereof; an interlock stopper 300 mounted on one side of the lower roller bracket 200 and pivoting to protrude toward the lower rail 100 when a window pane is opened; a locking device 400 mounted on the other side of the lower roller bracket 200; and a safety device 500 fixed on the lower rail 100 for holding the slide door 90 in an open state, the safety device 500 being locked to the locking device 400 by the interlock stopper 300 when the slide door 90 is opened with the opened window pane.

The slide door 90 includes a window regulator which is mounted, for example, on the side of the chassis and moves up or down the window pane, and an operation lever pivotally mounted on one side of the upper surface of the lower roller bracket 200 and connected to the window regulator via a cable. The interlock stopper 300 is connected to the operation lever so that the interlock stopper 300 is pivoted by the operating force of the operation lever.

The window pane, the window regulator, the cable and the operation lever are substantially similar in the construction and operation of those that are described in the description of the prior art, which the detailed description omits.

The lower rail 100 is mounted on the chassis in a fore-and-aft direction of the vehicle to guide the slide door 90 in the longitudinal direction of the vehicle. The slide door 50 is slidably connected to the lower rail 100 by the lower roller bracket 200.

The lower rail 100 and the lower rail bracket 200 are substantially similar in the construction and operation of those that are described in the description of the prior art, which the detailed description omits.

The interlock stopper 300 is mounted on one side of the lower roller bracket 200 displaced on the slide door 90 and is pivoted by the operation lever to protrude toward the lower rail 100 when a window pane is opened.

The safety device 500 comprises a case 510, a safety stopper 520 and a striker 530. The safety stopper 520 is displaced in the case 510 and functions to activate the striker 530 in accordance with the interlock stopper 300. The striker 530 is pivotally coupled to an end of the safety stopper 520.

In detail, the interlock stopper 300 is rotatably fixed to one end of the lower rail bracket 200 and is pivoted toward the lower rail 100 in accordance with the operation lever when the window pan is opened, and thereby the interlock stopper 300 pivotally pushes an end of the safety stopper 520 of the safety device 500. The pushed safety stopper 520 pivots the striker 530 and thus the locking device 400 is locked to the safety stopper 520 of the safety device 500 when the window pane is opened. However, the locking device 400 attached to the lower roller bracket 200 is locked to the window striker 600, which is mounted on the end of the lower rail 100 to hold the slide door 90 in a fully open state, when the window pane is closed.

The locking device 400 is widely known to lock a hood or door of a vehicle, the detailed description of which being omitted herein.

Hereinafter more detailed explanation about the safety device 500 will be followed.

The safety device 500 is configured to hold the slide door 90 substantially at a three-quarter point of the lower rail 100 so that the slide door 90 with the opened window pane is not fully closed or opened. In other words, in the case where the slide door 90 with the opened window pane is opened, the safety device 500 is locked to the locking device 400 by the interlock stopper 300 to hold the slide door 90 in the open state.

Figure 5:
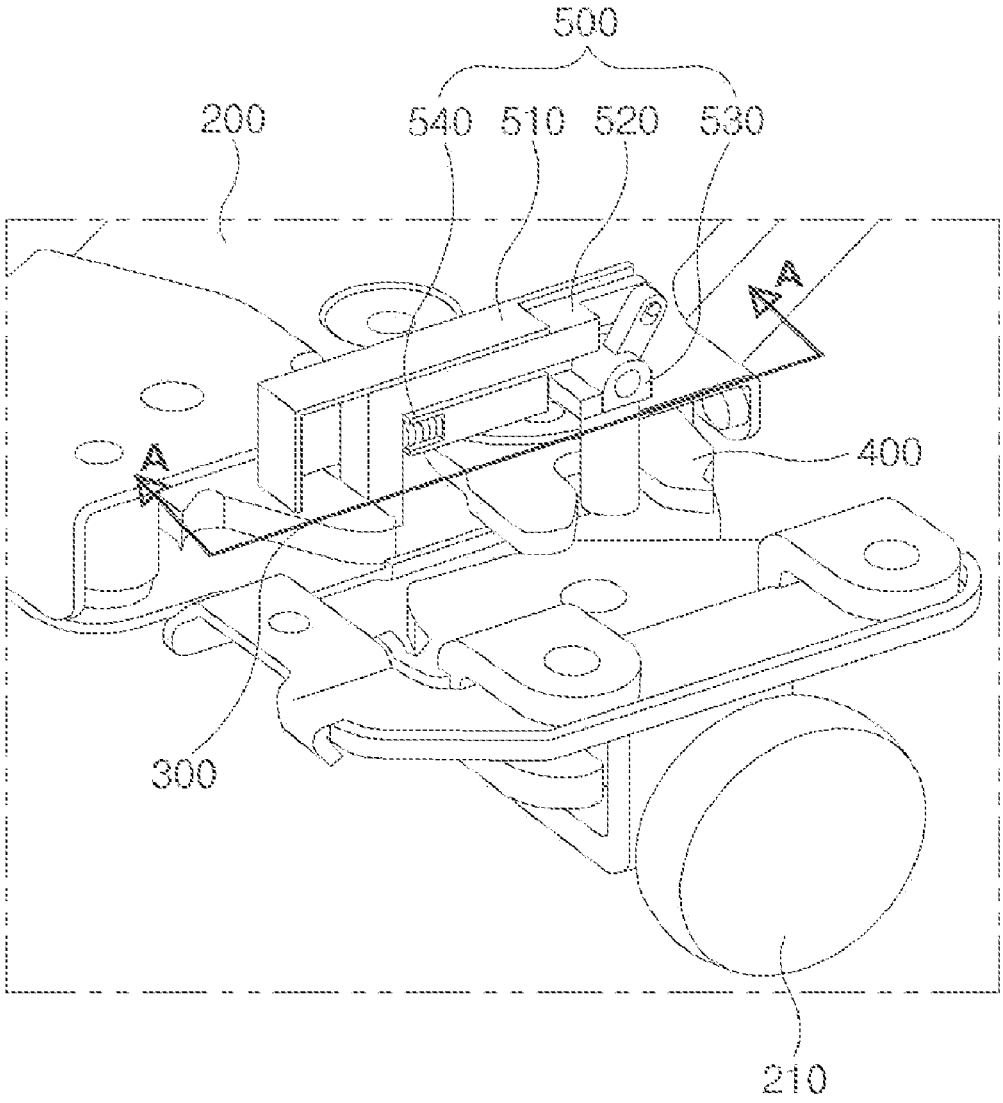
FIG. 5 is a perspective view illustrating the safety device according to an aspect of the present invention.

More specifically, the case 510 of the safety device 500, as shown in FIGS. 4 and 5, is coupled to one side of the lower rail 100, in which the lower rail bracket 200 is positioned on one side of the lower rail 100 when the slide door 90 is opened in a three-quarter state.

The safety stopper 520 of the safety device 500 is slidably coupled to the case 510 and positioned at one side of the case 510 to move in the longitudinal direction of the lower rail 100 and selectively activated by the interlock stopper 300.

The striker 530 of the safety device 500 is pivotally coupled to the safety stopper 520 and pivotally rotated by movement of the safety stopper 520 and thus locked to the locking device 400.

The safety stopper 520 further comprises a resilient member 540 for resiliently supporting the safety stopper 520.

Figure 6:
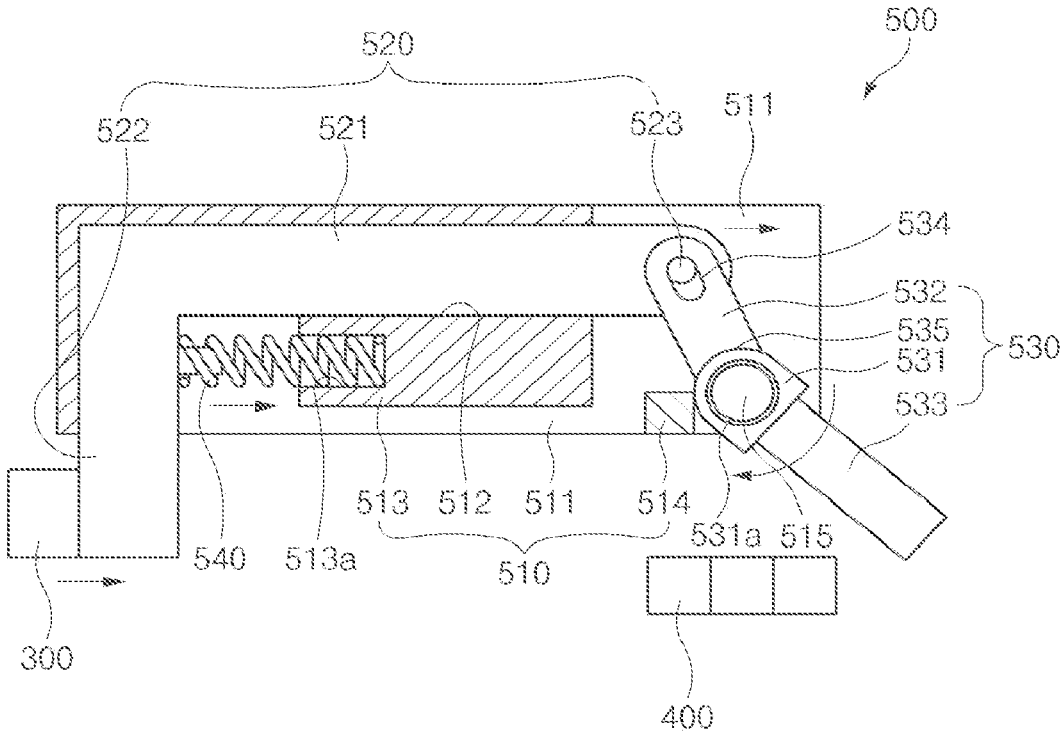
FIG. 6 is a cross-sectional view, similar to FIG. 7 below, illustrating the state before an exemplary slide door assembly with a safety device is actuated.

As shown in FIG. 6, the case 510 of the safety stopper 520 has a fixing portion 511 fixed to the lower rail 100, a guide groove 512 for movably receiving the safety stopper 520 therein, a support portion 513 with a groove 513*a* for receiving one side of the resilient member 540, and a locking portion 514 for guiding the striker 530 to be engaged or disengaged from the locking device 400 as explained later in detail.

The safety stopper 520 of the safety stopper 520 has a horizontal portion 521 slidably inserted in the guide groove 512 of the case 510, in which the horizontal portion 521 is moved in to the guide groove along the lower rail 100, a vertical portion 522 downwardly extending from one side of the horizontal portion 521 and abutting against the interlock stopper 300, and a hinge shaft 523 provided on the other side of the horizontal portion 521.

The striker 530 of the safety stopper 520 has a hinge portion 531 pivotally fixed to the other side of the case 510 via a hinge shaft 515 formed on the case 510, an engaging piece 532 provided on one side of the hinge portion 531 and rotatably engaged with the hinge shaft 523 of the safety stopper 520 through the slot 534, and a locking piece 533 provided on the other side of the hinge portion 531 and selectively locked to the locking device 400. The hinge portion 531 further comprises a cam 535 to guide the trajectory of the locking piece 533 for locking or unlocking the locking piece 533 into or from the locking device 400. The cam 535 of the hinge portion 531 may rotate about the locking portion 514. Further since the hinge shaft 523 and the hinge shaft 515 can move in the slots 531*a* and 534, the locking portion 514 can smoothly be engaged to or disengaged from the locking device 400 as the cam 535 rotates around the locking portion 514.

The resilient member 540 of the safety stopper 520 is interposed between the vertical portion 522 of the safety stopper 520 and the groove 513*a* of the support portion 513 to resiliently support the safety stopper 520 toward the interlock stopper 300.

The resilient member 540 may be a coil spring.

The operation of the slide door assembly with the safety device will now be described.

In the case where the window pane is closed, the cable is maintained in a gentle state by the window regulator, and the operation lever is not actuated by the cable. Consequently, the interlock stopper 300 is positioned in the inside of the lower roller bracket 200.

If the slide door 90 is opened in this situation, the lower roller bracket 200 is slid along the lower rail 100. In this instance, the interlock stopper 300 is positioned in the inside of the lower roller bracket 200, and is moved without being locked by the safety stopper 520 of the safety device 500. Then, the locking device 400 mounted on the lower roller bracket 200 is locked to the window striker 600 that is installed on the end of the lower rail 100, thereby holding the slide door in the open state.

Since the window pane of the slide door is fully closed, a portion of a human body of a passenger cannot exist in an open space of the window pane. Therefore, the slide door can be fully opened.

Figure 7:
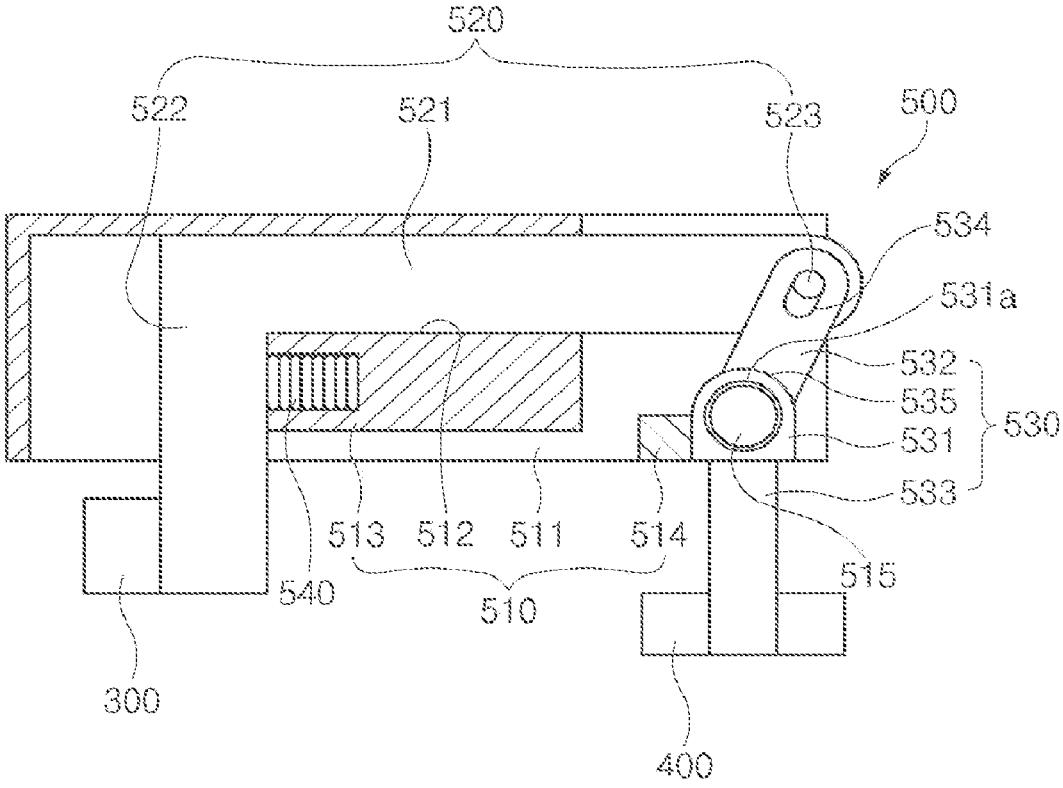
FIG. 7 is a cross-sectional view, taken along line A-A of FIG. 5, illustrating the state after an exemplary slide door assembly with a safety device is actuated.

As shown in FIGS. 6 and 7, in the state where the window pane is opened in a dangerous state, the cable is pulled by the regulator, and the operation lever is actuated by the cable and thereby the interlock stopper 300 is pivoted to the outside of the lower roller bracket 200, and is maintained in a protruding state.

In this instance, if the slide door 90 is opened, the lower roller bracket 200 is slid along the lower rail 100. At that time, the interlock stopper 300 is actuated substantially at a three-quarter portion by the safety stopper 520, and simultaneously, moves the safety stopper 520. The striker 530 is pivoted in a downward direction until the striker 530 abuts against the locking portion 514, so that it is locked by the locking device 400.

Since the striker 530 is locked by the locking device 400, the slide door is held substantially in a three-quarter open state. In this instance, even though a portion of a human body of a passenger is exposed in an open area of the window pane, it is possible to prevent the passenger from being injured. Also, it is possible to prevent the slide door from being again closed even though a vehicle is parked on a downhill slope.

For convenience in explanation and accurate definition in the appended claims, the terms "up" or "upper", "down" or "lower", "front" or "rear", "inside", and etc. are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A slide door assembly and a safety device for a vehicle, comprising:

a lower rail provided on a chassis of the vehicle in a longitudinal direction of the vehicle;

a lower roller bracket mounted on a slide door and slidably engaged with the lower rail;

an interlock stopper mounted on one side of the lower roller bracket and protruding toward the lower rail when a window pane is opened;

a locking device mounted on the other side of the lower roller bracket; and a safety device for holding the slide door in an open state, the safety device being locked to the locking device by the interlock stopper while the window pane and the slide door are opened, wherein the safety device comprises:

a case attached to one side of the lower rail;

a safety stopper movably coupled to the case and abutting against the interlock stopper, the safety stopper actuated by the interlock stopper;

a striker actuated by the safety stopper and thereby pivotally locked to the locking device of the lower roller bracket; and a resilient member for resiliently supporting the safety stopper, and wherein the safety stopper comprises:

a horizontal portion formed on one side of the case and movable in a longitudinal direction of the lower rail;

a vertical portion extending downwardly from one side of the horizontal portion and abutting against the interlock stopper; and a hinge shaft provided on the other side of the horizontal portion.

2. The slide door assembly as claimed in claim 1, wherein the lower roller bracket comprises a roller.

3. The slide door assembly as claimed in claim 1, wherein the safety device is displaced approximately at a three-quarter point of the lower rail.

4. The slide door assembly as claimed in claim 1, wherein the resilient member is a coil spring.

5. The slide door assembly as claimed in claim 1, wherein the striker comprises:

a hinge portion pivotally coupled to a portion of the case via a hinge shaft formed on the case;

an engaging piece provided on one side of the hinge portion and rotatably engaged with the hinge shaft of the safety stopper via a slot; and a locking piece provided on the other side of the hinge portion and selectively locked to the locking device.

6. The slide door assembly as claimed in claim 5, wherein the hinge portion comprises a cam and the case comprises a locking portion, and the cam rotates around the locking portion as a center of rotation of the striker.

7. The slide door assembly as claimed in claim 5, wherein the hinge portion, engaging piece and locking piece are monolithically formed.

8. The slide door assembly as claimed in claim 7, wherein the hinge portion comprises a cam and the case comprises a locking portion and the cam rotates around the locking portion as a center of rotation of the striker.

* * * * *